US010814152B1

(12) United States Patent
Aryee

(10) Patent No.: US 10,814,152 B1
(45) Date of Patent: Oct. 27, 2020

(54) AUTOMATIC FIRE EXTINGUISHER

(71) Applicant: Frederick Aryee, San Diego, CA (US)

(72) Inventor: Frederick Aryee, San Diego, CA (US)

( * ) Notice: Subject to any disclaimer, the term of this patent is extended or adjusted under 35 U.S.C. 154(b) by 30 days.

(21) Appl. No.: 15/936,722

(22) Filed: Mar. 27, 2018

(51) Int. Cl.
*A62C 37/48* (2006.01)
*A62C 35/02* (2006.01)

(52) U.S. Cl.
CPC ..... *A62C 37/48* (2013.01); *A62C 35/023* (2013.01)

(58) Field of Classification Search
CPC ..... A62C 37/48; A62C 35/023
USPC ..... 169/5, 9, 14, 15, 37–42, 47, 46, 57, 65, 169/71, 74, 90
See application file for complete search history.

(56) References Cited

U.S. PATENT DOCUMENTS 2,871,952 A * 2/1959 Doak ..... A62C 13/003 169/26
4,592,301 A * 6/1986 Monte ..... G08B 13/1472 116/162
D307,647 S 5/1990 Yasuo
5,315,292 A 5/1994 Prior
6,540,155 B1 4/2003 Yahav
7,172,031 B2 2/2007 Piatti
7,182,144 B2 2/2007 Baba
8,333,246 B2 * 12/2012 Hanratty ..... A62C 13/64 169/33
8,607,888 B2 12/2013 Nusbaum
8,973,671 B2 3/2015 Alsaif
9,345,914 B1 5/2016 Haji
2003/0079888 A1 * 5/2003 Sundholm ..... A62C 35/023 169/5
2008/0087446 A1 * 4/2008 Sitabkhan ..... A62C 37/12 169/57
2011/0290510 A1 * 12/2011 Hanratty ..... A62C 13/64 169/74
2012/0048577 A1 * 3/2012 Ball ..... A62C 3/00 169/46
2016/0279453 A1 * 9/2016 Ernfjall ..... A62C 3/07
2017/0028238 A1 * 2/2017 Meyer ..... A62C 37/11

FOREIGN PATENT DOCUMENTS

WO 2008103282 A 8/2008

* cited by examiner

*Primary Examiner* — Qingzhang Zhou
(74) *Attorney, Agent, or Firm* — Kyle A. Fletcher, Esq.

(57) ABSTRACT

The automatic fire extinguisher is a temperature sensitive device. The automatic fire extinguisher dispenses the fire retardant when the temperature of the automatic fire extinguisher reaches a predetermined temperature. When the predetermined temperature is reached, the automatic fire extinguisher releases a fire retardant in the form of a compressed gas into the atmosphere. In a subsequent embodiment of the disclosure, the automatic fire extinguisher releases both the fire retardant and water into the atmosphere. The automatic fire extinguisher is formed with one moving part and no mechanical linkages. The subsequent embodiment is formed with two moving parts and no mechanical linkages. The automatic fire extinguisher comprises a compressed retardant gas, a high-pressure gas tank, a release valve, a nozzle, a whistle and a housing. The subsequent embodiment comprises the components of the prior embodiment and further comprises a chamber, a plug, water, and a check valve.

15 Claims, 5 Drawing Sheets

AUTOMATIC FIRE EXTINGUISHER

CROSS REFERENCES TO RELATED APPLICATIONS

Not Applicable

STATEMENT REGARDING FEDERALLY SPONSORED RESEARCH

Not Applicable

REFERENCE TO APPENDIX

Not Applicable

BACKGROUND OF THE INVENTION

Field of the Invention

The present invention relates to the field of life-saving including firefighting equipment, more specifically, a fire extinguisher with a single permanently pressurized chamber.

SUMMARY OF INVENTION

The automatic fire extinguisher is an automated fire retardant dispensing device. The automatic fire extinguisher is a self-contained unit. The automatic fire extinguisher is a temperature sensitive device. The automatic fire extinguisher dispenses the fire retardant when the temperature of the automatic fire extinguisher reaches a predetermined temperature. In the primary embodiment of the automatic fire extinguisher, when the predetermined temperature is reached the automatic fire extinguisher releases a fire retardant in the form of a compressed gas into the atmosphere. In a secondary embodiment of the disclosure, the automatic fire extinguisher releases both the fire retardant and water into the atmosphere. The primary embodiment is formed with one moving part and no mechanical linkages. The secondary embodiment is formed with two moving parts and no mechanical linkages. The primary embodiment comprises a compressed retardant gas, a high-pressure gas tank, a release valve, a nozzle, a whistle and a housing. The secondary embodiment comprises the components of the primary embodiment and further comprises a chamber, a plug, water, and a check valve.

These together with additional objects, features and advantages of the automatic fire extinguisher will be readily apparent to those of ordinary skill in the art upon reading the following detailed description of the presently preferred, but nonetheless illustrative, embodiments when taken in conjunction with the accompanying drawings.

In this respect, before explaining the current embodiments of the automatic fire extinguisher in detail, it is to be understood that the automatic fire extinguisher is not limited in its applications to the details of construction and arrangements of the components set forth in the following description or illustration. Those skilled in the art will appreciate that the concept of this disclosure may be readily utilized as a basis for the design of other structures, methods, and systems for carrying out the several purposes of the automatic fire extinguisher.

It is therefore important that the claims be regarded as including such equivalent construction insofar as they do not depart from the spirit and scope of the automatic fire extinguisher. It is also to be understood that the phraseology and terminology employed herein are for purposes of description and should not be regarded as limiting.

BRIEF DESCRIPTION OF DRAWINGS

The accompanying drawings, which are included to provide a further understanding of the invention are incorporated in and constitute a part of this specification, illustrate an embodiment of the invention and together with the description serve to explain the principles of the invention. They are meant to be exemplary illustrations provided to enable persons skilled in the art to practice the disclosure and are not intended to limit the scope of the appended claims.

DETAILED DESCRIPTION OF THE EMBODIMENT

The following detailed description is merely exemplary in nature and is not intended to limit the described embodiments of the application and uses of the described embodiments. As used herein, the word "exemplary" or "illustrative" means "serving as an example, instance, or illustration." Any implementation described herein as "exemplary" or "illustrative" is not necessarily to be construed as preferred or advantageous over other implementations. All of the implementations described below are exemplary implementations provided to enable persons skilled in the art to practice the disclosure and are not intended to limit the scope of the appended claims. Furthermore, there is no intention to be bound by any expressed or implied theory presented in the preceding technical field, background, brief summary or the following detailed description.

Figure 1:
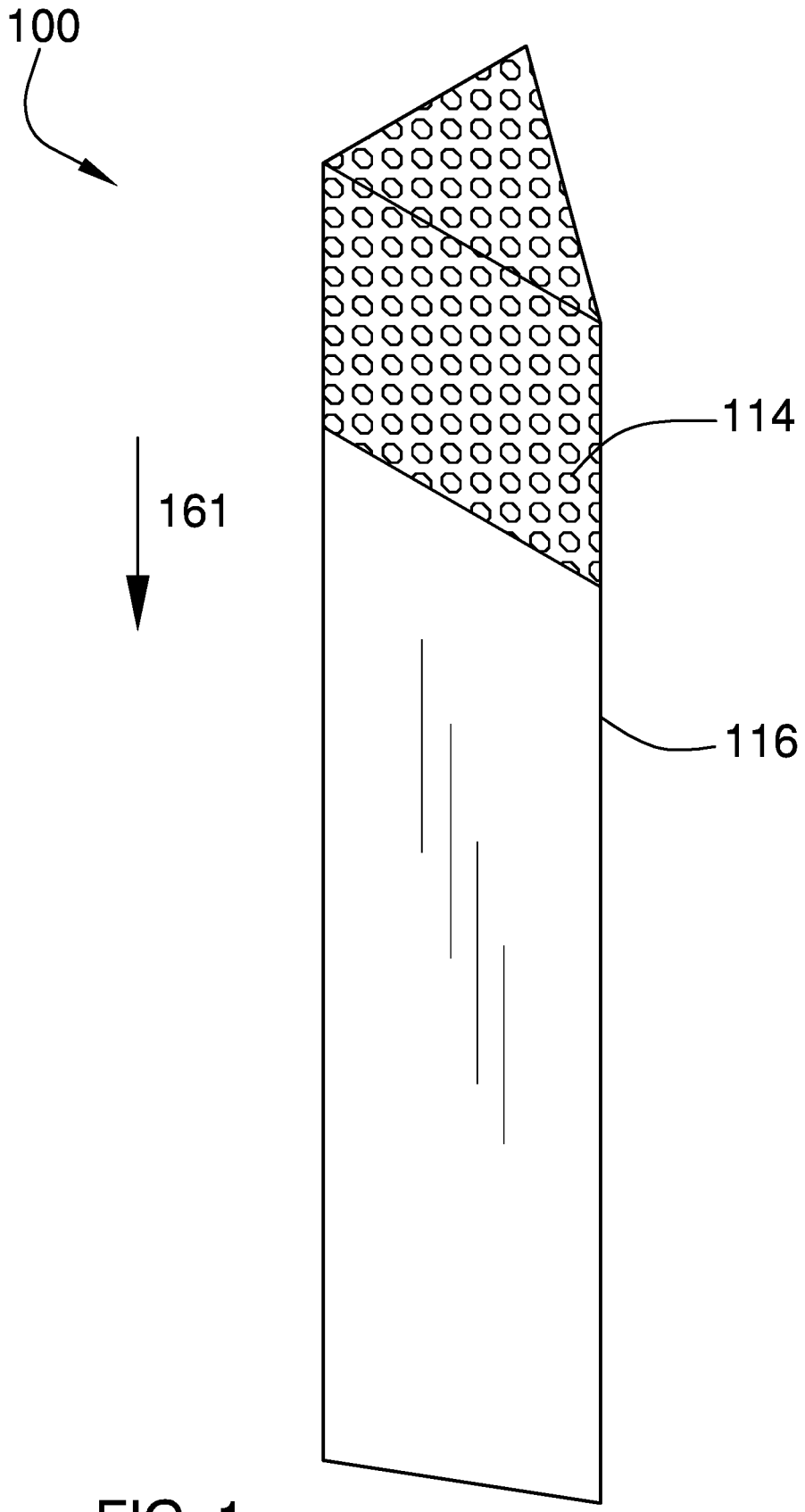
FIG. 1 is a perspective view of an embodiment of the disclosure.
Figure 2:
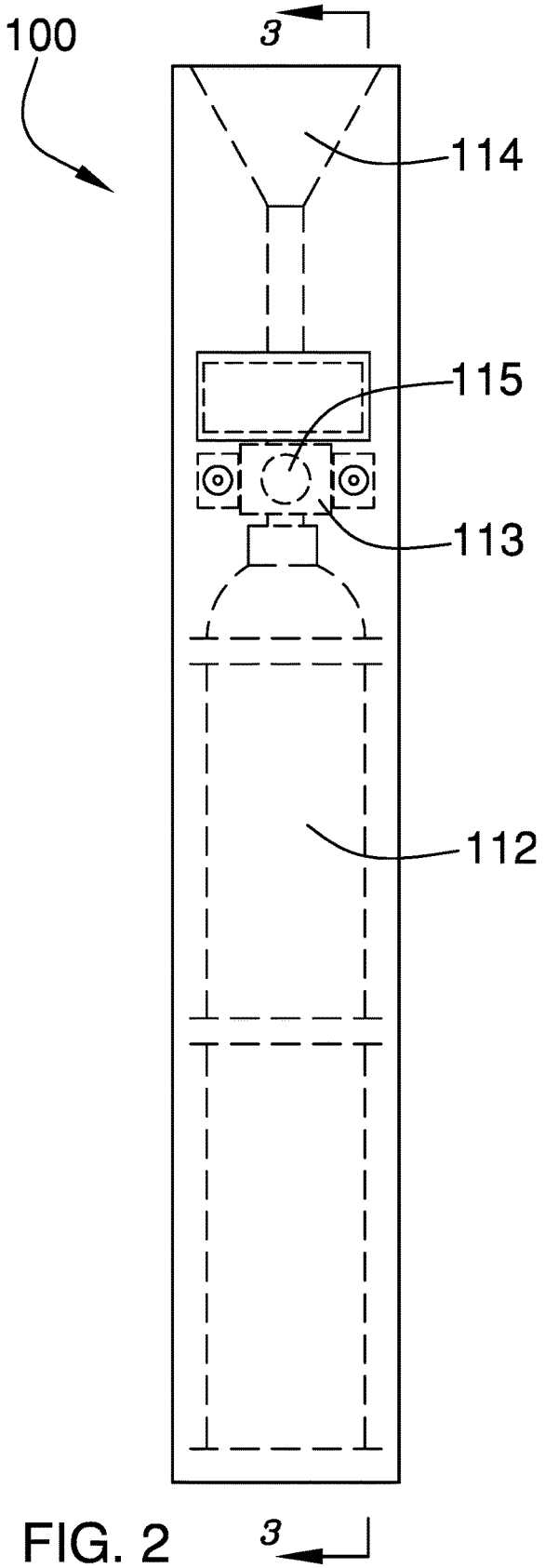
FIG. 2 is a rear view of an embodiment of the disclosure.
Figure 3:
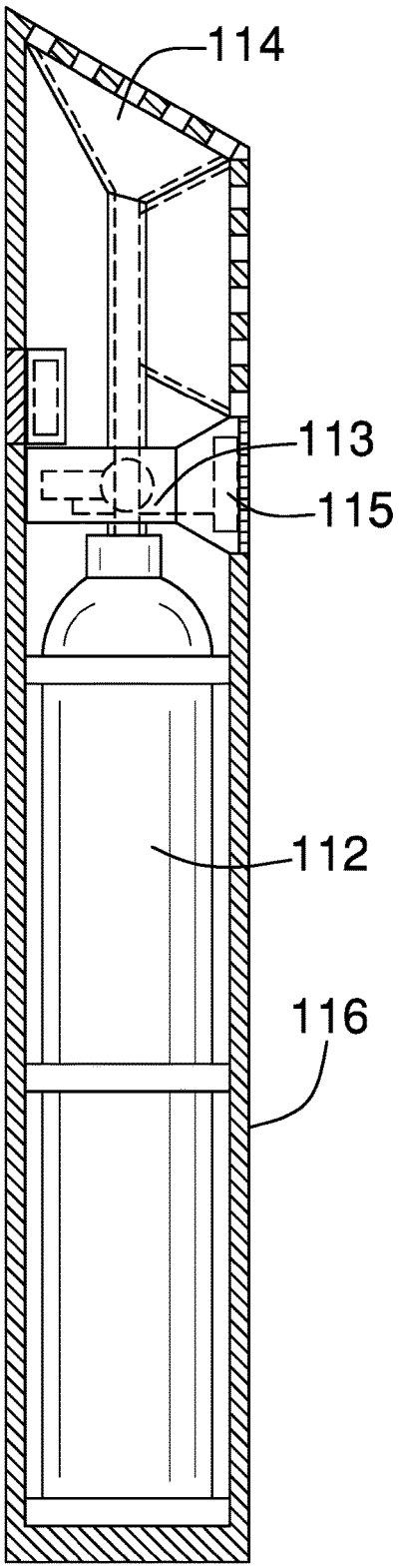
FIG. 3 is a cross-sectional view of an embodiment of the disclosure across 3-3 as shown in FIG. 2.
Figure 4:
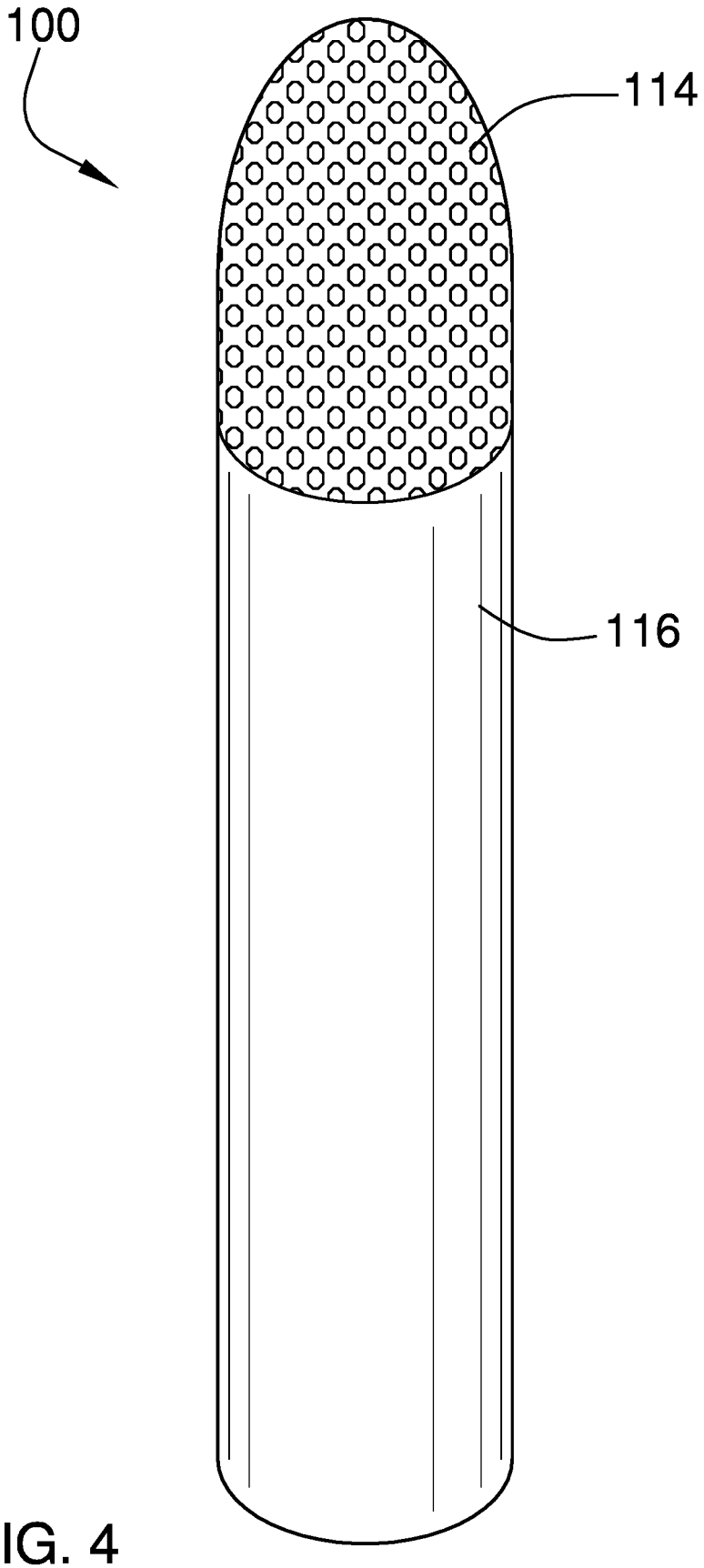
FIG. 4 is a perspective view of an alternate embodiment of the disclosure.
Figure 5:
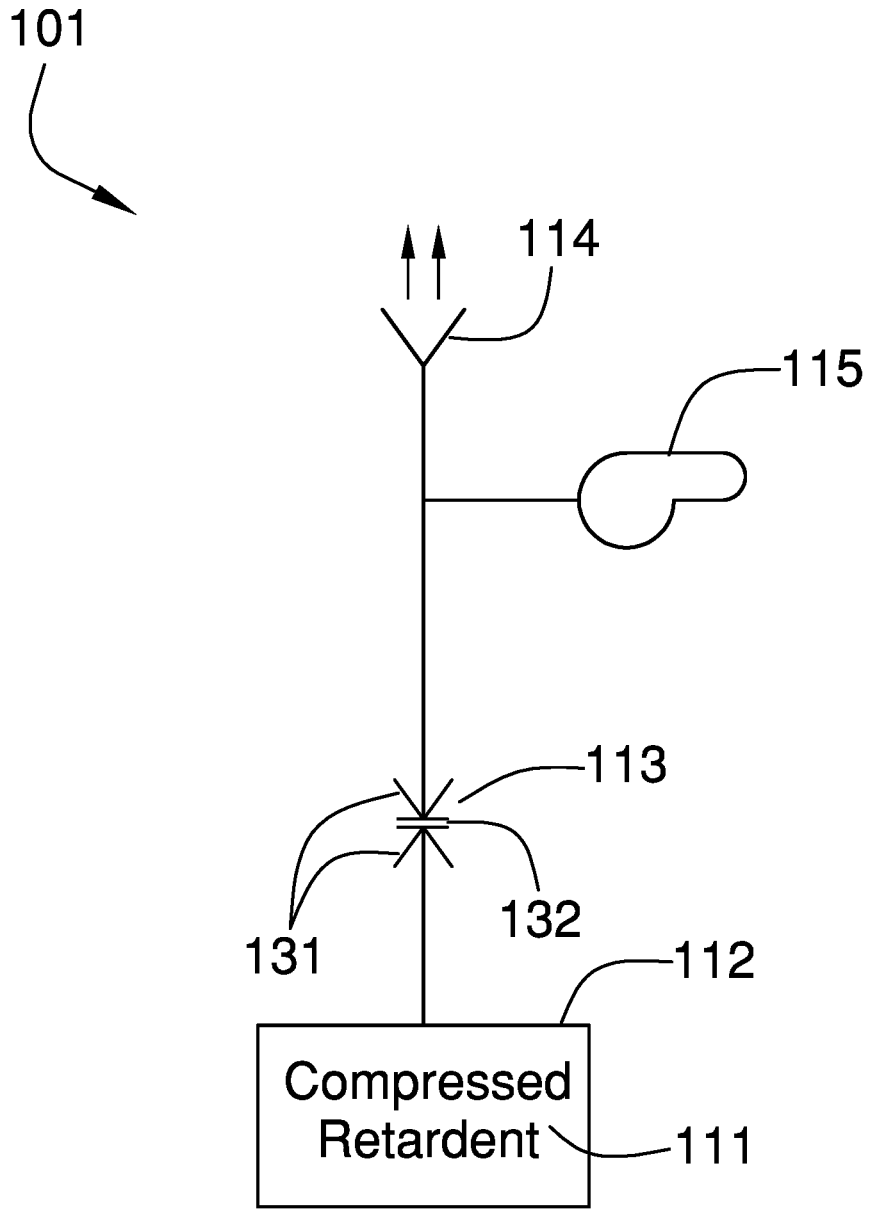
FIG. 5 is a schematic view of an embodiment of the disclosure.
Figure 6:
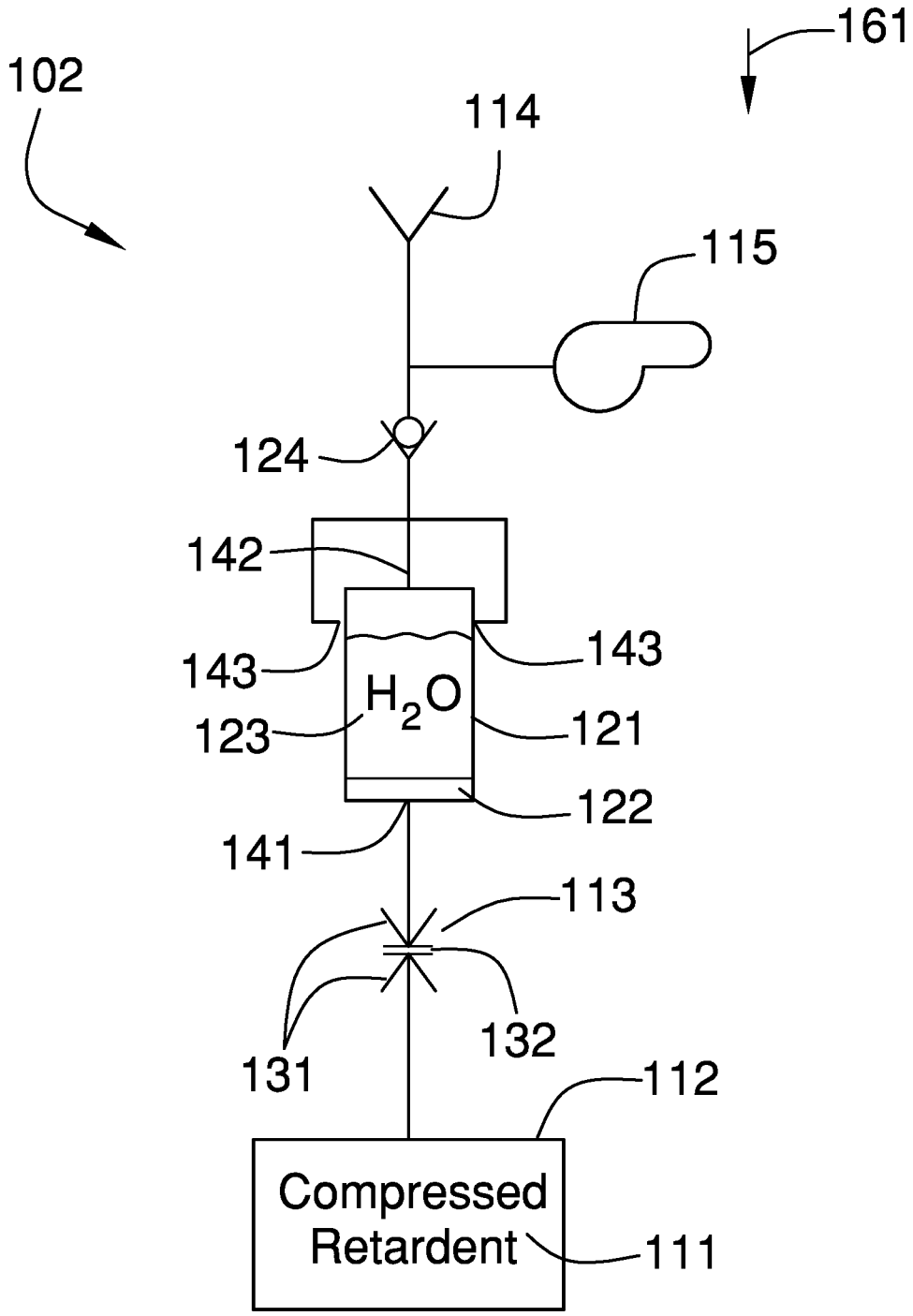
FIG. 6 is a schematic view of the alternate embodiment of the disclosure.

Detailed reference will now be made to one or more potential embodiments of the disclosure, which are illustrated in FIGS. 1 through 6.

The automatic fire extinguisher 100 (hereinafter invention) is an automated fire retardant dispensing device. The invention 100 is a self-contained unit. The invention 100 is a temperature sensitive device. The invention 100 dispenses the fire retardant when the temperature of the invention 100 reaches a predetermined temperature. In the primary embodiment 101 of the invention 100, when the predetermined temperature is reached, the invention 100 releases a fire retardant in the form of a compressed gas into the atmosphere. In a secondary embodiment 102 of the disclosure, the invention 100 releases both the fire retardant and water 123 into the atmosphere. The primary embodiment 101 is formed with one moving part and no mechanical linkages. The secondary embodiment 102 is formed with two moving parts and no mechanical linkages. The primary embodiment 101 comprises a compressed retardant gas 111, a high-pressure gas tank 112, and a release valve 113, a nozzle 114, a whistle 115 and a housing 116. The secondary embodiment 102 comprises the components of the primary embodiment 101 and further comprises a chamber 121, a plug 122, water 123, and a check valve 124.

The invention 100 comprises a primary embodiment 101. The primary embodiment 101 is the primary fire extinguishing mechanism of the invention 100. The primary embodiment 101 releases an inert gas into the atmosphere, which deprives a fire of oxygen. The primary embodiment 101 is an automated device. The primary embodiment 101 comprises one moving part. The primary embodiment 101 does not use any mechanical linkages. The primary embodiment 101 comprises a compressed retardant gas 111, a high-pressure gas tank 112, a release valve 113, a nozzle 114, a whistle 115, and a housing 116. The compressed retardant gas 111, the high-pressure gas tank 112, the release valve 113, the nozzle 114, and the whistle 115 are fluidically interconnected. The housing 116 contains the high-pressure gas tank 112, the release valve 113, and the whistle 115. The high-pressure gas tank 112 contains the compressed retardant gas 111.

The compressed retardant gas 111 is the inert gas that is released from the primary embodiment 101. The compressed retardant gas 111 is stored under pressure in the high-pressure gas tank 112. The compressed retardant gas 111 is a gas that reduces the concentration of oxygen around the fire thereby retarding the combustion process. The compressed retardant gas 111 is non-toxic. The compressed retardant gas 111 is selected to have a molecular weight less than oxygen. The compressed retardant gas 111 is diatomic nitrogen. The choice of diatomic nitrogen allows the compressed retardant gas 111 to concentrate in the superior regions of a room. In an emergency situation, the tendency of the released diatomic nitrogen to remain above the oxygen in the atmosphere allows a person to escape the fire by crawling along the ground without risk of asphyxiation.

The high-pressure gas tank 112 is a commercially available cylindrical tank that is rated to store gas under pressure.

The release valve 113 is a spring-loaded valve that controls the flow of the compressed retardant gas 111 out of the high-pressure gas tank 112. The release valve 113 is thermally sensitive. Specifically, the release valve 113 is designed to open automatically when the temperature of the invention 100 reaches the predetermined temperature. The release valve 113 comprises a normally open spring-loaded valve 131 and a thermal epoxy detent 132.

The normally open spring-loaded valve 131 is a commercially available spring-loaded valve. The normally open spring-loaded valve 131 is in the open position when the spring is in its relaxed shape. The spring of the normally open spring-loaded valve 131 is deformed under a force to close the valve.

The thermal epoxy detent 132 is epoxy adhesive that is used to glue the spring of the normally open spring-loaded valve 131 in its deformed position such that the normally open spring-loaded valve 131 is fixed in a closed position. The method to adhere the spring of the normally open spring-loaded valve 131 into the closed position is similar to the methods used to form the "popup thermometer" commonly found in commercially available poultry products.

The thermal epoxy detent 132 is formed from a thermal epoxy. The thermal epoxy is a form of epoxy that is designed to melt at a predetermined temperature. When the temperature of the invention 100 reaches the predetermined temperature, the thermal epoxy forming the thermal epoxy detent 132 will melt thereby releasing the spring of the normally open spring-loaded valve 131. The melting of the thermal epoxy detent 132 thereby releases the compressed retardant gas 111 from the high-pressure gas tank 112 in an emergency situation.

The nozzle 114 is a commercially available device that releases the compressed retardant gas 111 from the invention 100. Fluids discharged through the nozzle 114 are directed in the superior direction, opposite to the force of gravity 161. The nozzle 114 is mounted on the superior end of the housing 116. The design and use of the nozzle 114 is well-known and documented fluidic arts.

The whistle 115 is a commercially available device that converts a gas flow into an audible sound. The whistle 115 generates an audible alarm when the compressed retardant gas 111 is released.

The housing 116 is a cylindrical structure that forms a portion of the exterior surfaces of the invention 100. The housing 116 is formed with all apertures and form factors necessary to allow the housing 116 to accommodate the use and operation of the invention 100.

The release valve 113 is the only moving part used in the primary embodiment 101 of the invention 100.

This paragraph describes the assembly of the primary embodiment 101 of the invention 100. The high-pressure gas tank 112 contains the compressed retardant gas 111. The release valve 113 fluidically connects the high-pressure gas tank 112 to the nozzle 114. The release valve 113 fluidically connects the high-pressure gas tank 112 to the whistle 115.

This paragraph describes the operation of the primary embodiment 101 of the invention 100. When the temperature of the invention 100 reaches the predetermined temperature, the thermal epoxy that forms the thermal epoxy detent 132 melts. The melting of the thermal epoxy detent 132 releases the normally open spring-loaded valve 131 into the open position. The opening of the release valve 113 releases the compressed retardant gas 111 through the nozzle 114 and the whistle 115. The nozzle 114 directs the released compressed retardant gas 111 out of the housing 116 in the superior direction. As the compressed retardant gas 111 passes through the whistle 115, the whistle 115 generates an audible sound that serves as an alarm that the compressed retardant gas 111 has been released in response to a potentially dangerous situation.

The invention 100 further comprises an extension of the primary embodiment 101 known as the secondary embodiment 102. The secondary embodiment 102 performs the functions of the primary embodiment 101. The secondary embodiment 102 further enhances the firefighting mechanism of the primary embodiment 101 by releasing water 123 before the release of the inert gas. The secondary embodiment 102 initially releases the water 123 through the nozzle 114 to deprive the fire of oxygen. The secondary embodiment 102 subsequently releases the inert gas into the atmosphere to further deprive the fire of oxygen. The secondary embodiment 102 comprises two independent moving parts. The secondary embodiment 102 does not use any mechanical linkages.

The secondary embodiment 102 comprises all the elements of the primary embodiment 101 and further comprises a chamber 121, a plug 122, water 123, and a check valve 124. The chamber 121 contains the plug 122 and the water 123. The check valve 124 forms a fluidic connection with the chamber 121. The secondary embodiment 102 is fluidically connected with the primary embodiment 101.

The chamber 121 is a cylindrical tank that forms a containment structure. The water 123 discharged by the secondary embodiment 102 of the invention 100 is stored in the chamber 121. The chamber 121 is sized to fit within the housing 116. The chamber 121 further comprises a gas inlet port 141, a water release port 142, and a gas release port 143.

The gas inlet port 141 is a fitting that is formed in the inferior surface of the chamber 121. The compressed retardant gas 111 enters the chamber 121 through the gas inlet port 141.

The water release port 142 is a fitting that is formed in the superior surface of the chamber 121. The water 123 is forced out of the chamber 121 by the compressed retardant gas 111 and the plug 122 through the water release port 142.

The gas release port 143 is a fitting that is formed in the lateral face of the chamber 121. The span of the distance between the gas release port 143 and the superior surface of the chamber 121 is greater than the span of the lateral face of the plug 122 as measured parallel to the center axis of the plug 122. The compressed retardant gas 111 escapes the chamber 121 through the gas release port 143.

The plug 122 is a disk-shaped structure. The plug 122 is placed at the inferior end of the chamber 121 before the water 123 is introduced into the chamber 121. The plug 122 fits tightly into the chamber 121 such that a light seal is formed. By light seal is meant: 1) that the plug 122 forms a seal tight enough to prevent water 123 from leaking around the plug 122 into the gas inlet port 141 when the plug 122 is set at the inferior point of the chamber 121; but, 2) will not inhibit the elevation of the plug 122 when the compressed retardant gas 111 is released from the high-pressure gas tank 112.

When the compressed retardant gas 111 is released from the high-pressure gas tank 112, the compressed retardant gas 111 increases the elevation of the plug 122 such that the water 123 is pushed out of the invention 100.

The span of the lateral face of the plug 122 is selected such that the plug 122 clears the gas release port 143 once the plug 122 has been pushed to the superior end of the chamber 121.

The water 123 refers to the water 123 that is stored in the chamber 121. The water 123 is dispensed from the invention 100 to extinguish the combustion of the fire. The check valve 124 is a valve that allows for the passage of a fluid in a single direction.

The check valve 124 is configured to pass the water 123 and the compressed retardant gas 111 from the chamber 121 to the nozzle 114 and the whistle 115. The check valve 124 is used to prevent microorganisms from entering the invention 100 through the nozzle 114 and forming a colony in the water 123. The check valve 124 is described in greater detail elsewhere in this disclosure. In the secondary embodiment 102, the check valve 124 is a Tesla valve. The Tesla valve is selected because it has no moving parts.

The release valve 113 and the plug 122 are the only moving parts used in the secondary embodiment 102 of the invention 100.

The following two paragraphs describe the assembly of the secondary embodiment 102 of the invention 100.

The secondary embodiment 102 is a fluidic structure that is installed in series between the release valve 113 and the nozzle 114. The secondary embodiment 102 is a fluidic structure that is installed in series between the release valve 113 and the whistle 115. The gas inlet port 141 of the chamber 121 fluidically connects the release valve 113 such that the release valve 113 controls the flow of the compressed retardant gas 111 from the high-pressure gas tank 112 into the chamber 121.

The water release port 142 fluidically connects the chamber 121 to the check valve 124. The gas release port 143 fluidically connects the chamber 121 to the check valve 124. The check valve 124 fluidically connects the water release port 142 to the nozzle 114. The check valve 124 fluidically connects the gas release port 143 to the nozzle 114. The check valve 124 fluidically connects the water release port 142 to the whistle 115. The check valve 124 fluidically connects the gas release port 143 to the whistle 115.

The following two paragraphs describe the operation of the secondary embodiment 102 of the invention 100.

When the temperature of the invention 100 reaches the predetermined temperature, the thermal epoxy that forms the thermal epoxy detent 132 melts. The melting of the thermal epoxy detent 132 releases the normally open spring-loaded valve into the open position. The opening of the release valve 113 releases the compressed retardant gas 111 through the release valve 113 and the gas inlet port 141 into the chamber 121. The compressed retardant gas 111 builds up a pressure underneath the plug 122 that raises the plug 122 and the water stored above the plug 122, in the superior direction. As the water 123 is raised through the chamber 121, the pressure of the compressed retardant gas 111 forces the water 123 through the check valve 124 and out of the housing 116 through the nozzle 114 thereby dispensing the water 123 on to the fire.

When the plug 122 reaches the superior end of the chamber 121, the released compressed retardant gas 111 gains access to the gas release port 143. The gas release port 143 routes the compressed retardant gas 111 through the check valve 124 to the nozzle 114 and the whistle 115. Once the compressed retardant gas 111 is released from the check valve 124, the compressed retardant gas 111: 1) flushes the final amounts of water 123 from the invention 100, 2) is dispensed onto the fire through the nozzle 114; and, 3) flows through the whistle 115 thereby sounding the audible alarm.

The following definitions were used in this disclosure:

Ball Valve: As used in this disclosure, a ball valve is a type of commercially available check valve.

Center: As used in this disclosure, a center is a point that is: 1) the point within a circle that is equidistant from all the points of the circumference; 2) the point within a regular polygon that is equidistant from all the vertices of the regular polygon; 3) the point on a line that is equidistant from the ends of the line; 4) the point, pivot, or axis around which something revolves; or, 5) the centroid or first moment of an area or structure. In cases where the appropriate definition or definitions are not obvious, the fifth option should be used in interpreting the specification.

Center Axis: As used in this disclosure, the center axis is the axis of a cylinder or a prism. The center axis of a prism is the line that joins the center point of the first congruent face of the prism to the center point of the second corresponding congruent face of the prism. The center axis of a pyramid refers to a line formed through the apex of the pyramid that is perpendicular to the base of the pyramid. When the center axes of two cylinder, prism or pyramidal structures share the same line they are said to be aligned. When the center axes of two cylinder, prism or pyramidal structures do not share the same line they are said to be offset.

Chamber: As used in this disclosure, a chamber is an enclosed or enclosable space that is dedicated to a purpose.

Check Valve: As used in this disclosure, a check valve is a valve that permits the flow of fluid or gas in a single direction. Within selected potential embodiments of this disclosure, the check valve is a commercially available product that is selected from the group consisting of a ball valve and a Tesla valve.

Closed Position: As used in this disclosure, a closed position refers to a movable barrier structure that is in an orientation that prevents passage through a port or an aperture. The closed position is often referred to as an object being "closed."

Compress: In this disclosure, compress means to force into a smaller space.

Compressed Gas: In this disclosure, compressed gas refers to a gas that has been compressed to a pressure greater than atmospheric pressure.

Cylinder: As used in this disclosure, a cylinder is a geometric structure defined by two identical flat and parallel ends, also commonly referred to as bases, which are circular in shape and connected with a single curved surface, referred to in this disclosure as the lateral face. The cross-section of the cylinder remains the same from one end to another. The axis of the cylinder is formed by the straight line that connects the center of each of the two identical flat and parallel ends of the cylinder. Unless otherwise stated within this disclosure, the term cylinder specifically means a right cylinder which is defined as a cylinder wherein the curved surface perpendicularly intersects with the two identical flat and parallel ends.

Detent: As used in this disclosure, a detent is a device for positioning and holding a first object relative to a second object such that the position of the first object relative to the second object is adjustable.

Disk: As used in this disclosure, a disk is a cylindrically shaped object that is flat in appearance.

Elevation: As used in this disclosure, elevation refers to the span of the distance in the superior direction between a specified horizontal surface and a reference horizontal surface.

Epoxide: As used in this disclosure, an epoxide is a functional group formed by a cyclic ether wherein the first carbon atom of the ether and the second carbon atom of the ether are further joined by a covalent bond.

Epoxy: As used in this disclosure, an epoxy is polymer-based adhesive that is characterized by the use of an epoxide functional group. Epoxy resin is a synonym for epoxy.

Fitting: As used in this disclosure, a fitting is a component that is attached to a first object. The fitting is used to form a fluidic connection between the first object and a second object.

Fluidic Connection: As used in this disclosure, a fluidic connection refers to a tubular structure that transports a fluid from a first object to a second object. Methods to design and use a fluidic connection are well-known and documented in the mechanical, chemical, and plumbing arts.

Force of Gravity: As used in this disclosure, the force of gravity refers to a vector that indicates the direction of the pull of gravity on an object at or near the surface of the earth.

Form Factor: As used in this disclosure, the term form factor refers to the size and shape of an object.

High-Pressure Gas Tank: As used in this disclosure, a high-pressure gas tank is a container that is used to store compressed air.

Housing: As used in this disclosure, a housing is a rigid casing that encloses and protects one or more devices.

Inferior: As used in this disclosure, the term inferior refers to a directional reference that is parallel to and in the same direction as the force of gravity.

Mechanical Linkage: As used in this disclosure, a mechanical linkage is an interconnected arrangement of a plurality of components that are used to manage the transfer of a movement or a force. A mechanical linkage is often referred to as a linkage.

Nitrogen: As used in this disclosure, nitrogen (CAS 7727-37-9) refers to the element with atomic number 7 in the periodic table. The chemical abbreviation for nitrogen is N2.

Nozzle: As used in this disclosure, a nozzle is a device that receives fluid under pressure and releases the fluid in a controlled manner into an environment.

Open Position: As used in this disclosure, an open position refers to a movable barrier structure that is in an orientation that allows passage through a port or an aperture. The open position is often referred to as an object being "open."

Orientation: As used in this disclosure, orientation refers to the positioning of a first object relative to: 1) a second object; or, 2) a fixed position, location, or direction.

Port: As used in this disclosure, a port is an opening formed in an object that allows fluid to flow through the boundary of the object.

Pressure: As used in this disclosure, pressure refers to a measure of force per unit area.

Relaxed Shape: As used in this disclosure, a structure is considered to be in its relaxed state when no shear, strain, or torsional forces are being applied to the structure.

Spring: As used in this disclosure, a spring is a device that is used to store mechanical energy. This mechanical energy will often be stored by: 1) deforming an elastomeric material that is used to make the device; 2) the application of a torque to a rigid structure; or 3) a combination of the previous two items.

Superior: As used in this disclosure, the term superior refers to a directional reference that is parallel to and in the opposite direction of the force of gravity.

Tesla Valve: As used in this disclosure, a Tesla valve is a type of check valve that requires the use of no moving parts.

Thermal Epoxy: As used in this disclosure, a thermal epoxy is an epoxy that is designed to melt at a specific temperature. A thermal epoxy is often used to hold a component in a fixed position until the component reaches the melting point of the thermal epoxy. Thermal epoxies are commonly used in the manufacture of "popup thermometers" commonly found in poultry products.

Turbulence: As used in this disclosure, turbulence describes the motion or flow of a fluid wherein the velocities and pressures within the fluid flow will vary randomly or in an incalculably complex fashion.

Valve: As used in this disclosure, a valve is a device that is used to control the flow of a fluid (gas or liquid) through a pipe.

Whistle: As used in this disclosure, a whistle is a device that adds turbulence to a gas flow to create an audible sound.

With respect to the above description, it is to be realized that the optimum dimensional relationship for the various components of the invention described above and in FIGS. 1 through 6 include variations in size, materials, shape, form, function, and manner of operation, assembly and use, are deemed readily apparent and obvious to one skilled in the art, and all equivalent relationships to those illustrated in the drawings and described in the specification are intended to be encompassed by the invention.

It shall be noted that those skilled in the art will readily recognize numerous adaptations and modifications which can be made to the various embodiments of the present invention which will result in an improved invention, yet all of which will fall within the spirit and scope of the present invention as defined in the following claims. Accordingly, the invention is to be limited only by the scope of the following claims and their equivalents.

The inventor claims:

1. An automatic fire extinguisher comprising: wherein the automatic fire extinguisher is an automated fire retardant dispensing device; wherein the automatic fire extinguisher is a self-contained unit; wherein the automatic fire extinguisher is a temperature sensitive device; wherein the automatic fire extinguisher dispenses a fire retardant when a temperature of the automatic fire extinguisher reaches a predetermined temperature; wherein the fire retardant takes a form of an inert gas that is released into an atmosphere; a release valve comprises a spring-loaded valve and a thermal epoxy detent; wherein the thermal epoxy detent fixes the spring-loaded valve in a fixed position; wherein the thermal epoxy detent glues a spring of the spring-loaded valve in a deformed position such that the spring-loaded valve is fixed in a closed position; wherein the automatic fire extinguisher further comprises a secondary automatic fire extinguisher; wherein the secondary automatic fire extinguisher further releases water into the atmosphere; wherein the secondary automatic fire extinguisher further comprises a plug; wherein the secondary automatic fire extinguisher releases the water before the automatic fire extinguisher releases of the inert gas; wherein the secondary automatic fire extinguisher comprises a chamber, the plug, the water, and a check valve; wherein the chamber contains the plug and the water; wherein the check valve forms a fluidic connection with the chamber; wherein the secondary automatic fire extinguisher is fluidically connected with the automatic fire extinguisher.

2. The automatic fire extinguisher according to claim 1
wherein the automatic fire extinguisher comprises a compressed retardant gas, a high-pressure gas tank, the release valve, a nozzle, a whistle, and a housing;
wherein the compressed retardant gas, the high-pressure gas tank, the release valve, the nozzle, and the whistle are fluidically interconnected;
wherein the housing contains the high-pressure gas tank, the release valve, and the whistle;
wherein the high-pressure gas tank contains the compressed retardant gas.

3. The automatic fire extinguisher according to claim 2
wherein the compressed retardant gas is the inert gas that is released from the automatic fire extinguisher;
wherein the compressed retardant gas is stored under pressure in the high-pressure gas tank;
wherein the compressed retardant gas is non-toxic;
wherein the compressed retardant gas is selected to have a molecular weight less than oxygen.

4. The automatic fire extinguisher according to claim 3
wherein the high-pressure gas tank is a cylindrical tank;
wherein the high-pressure gas tank stores the inert gas under pressure.

5. The automatic fire extinguisher according to claim 4 wherein the release valve controls a flow of the compressed retardant gas out of the high-pressure gas tank; wherein the release valve is designed to open automatically when the temperature of the automatic fire extinguisher reaches the predetermined temperature.

6. The automatic fire extinguisher according to claim 5 wherein the release valve is a first moving part of the automatic fire extinguisher.

7. The automatic fire extinguisher according to claim 6
wherein the spring-loaded valve is in an open position when the spring is in its relaxed shape; wherein the spring of the spring-loaded valve is deformed under a force to close the spring-loaded valve.

8. The automatic fire extinguisher according to claim 7 wherein the thermal epoxy detent is formed from a thermal epoxy; wherein the thermal epoxy is a form of epoxy that is designed to melt at the predetermined temperature; wherein when the temperature of the automatic fire extinguisher reaches the predetermined temperature, the thermal epoxy forming the thermal epoxy detent will melt thereby releasing the spring of the spring-loaded valve; wherein the melting of the thermal epoxy detent thereby releases the compressed retardant gas from the high-pressure gas tank in an emergency situation.

9. The automatic fire extinguisher according to claim 8 wherein the nozzle releases the compressed retardant gas from the automatic fire extinguisher; wherein fluids discharged through the nozzle are directed in a direction opposite to a force of gravity; wherein the nozzle is mounted on a superior end of the housing; wherein the whistle converts a gas flow into an audible sound which serves as an audible alarm when the compressed retardant gas is released; wherein the housing is a cylindrical structure.

10. The automatic fire extinguisher according to claim 9
wherein the high-pressure gas tank contains the compressed retardant gas;
wherein the release valve fluidically connects the high-pressure gas tank to the nozzle;
wherein the release valve fluidically connects the high-pressure gas tank to the whistle;
wherein the compressed retardant gas is diatomic nitrogen.

11. The automatic fire extinguisher according to claim 10 wherein the chamber is a cylindrical tank; wherein the chamber is sized to fit within the housing; wherein the chamber further comprises a gas inlet port, a water release port, and a gas release port; wherein the gas inlet port is formed in an inferior surface of the chamber; wherein the water release port is formed in a superior surface of the chamber; wherein the gas release port is formed in a lateral face of the chamber.

12. The automatic fire extinguisher according to claim 11 wherein the plug is a disk-shaped structure; wherein the plug is placed at an inferior end of the chamber before the water is introduced into the chamber; wherein the plug fits into the chamber such that a seal is formed; wherein when the compressed retardant gas is released from the high-pressure gas tank, the compressed retardant gas increases an elevation of the plug such that the water is pushed out of the automatic fire extinguisher.

13. The automatic fire extinguisher according to claim 12 wherein the compressed retardant gas enters the chamber through the gas inlet port; wherein the water is forced out of the chamber by the compressed retardant gas and the plug through the water release port; wherein the compressed retardant gas escapes the chamber through the gas release port; wherein a span of a distance between the gas release port and the superior surface of the chamber is greater than a span of a lateral face of the plug as measured parallel to a center axis of the plug.

14. The automatic fire extinguisher according to claim 13 wherein the check valve allows for a passage of a fluid in a single direction; wherein the check valve is installed to pass the water and the compressed retardant gas in a direction from the chamber to the nozzle and the whistle; wherein the check valve is a Tesla valve.

15. The automatic fire extinguisher according to claim 14 wherein the high-pressure gas tank contains the compressed retardant gas; wherein the secondary automatic fire extinguisher is installed in series between the release valve and the nozzle; wherein the secondary automatic fire extinguisher is installed in series between the release valve and the whistle; wherein the gas inlet port of the chamber fluidically connects the release valve such that the release valve controls the flow of the compressed retardant gas from the high-pressure gas tank into the chamber; wherein the water release port fluidically connects the chamber to the check valve; wherein the gas release port fluidically connects the chamber to the check valve; wherein the check valve fluidically connects the water release port to the nozzle; wherein the check valve fluidically connects the gas release port to the nozzle; wherein the check valve fluidically connects the water release port to the whistle; wherein the check valve fluidically connects the gas release port to the whistle.

* * * * *